US008336139B2

(12) United States Patent
Wen et al.

(10) Patent No.: US 8,336,139 B2
(45) Date of Patent: Dec. 25, 2012

(54) MULTIFUNCTIONAL TURN-OVER NURSING BED

(75) Inventors: Yiping Wen, Yichun (CN); Yuqing Zhong, Yichun (CN)

(73) Assignee: Jiangxi Peiyuan Technology Development Co., Ltd., Jiangxi (CN)

( * ) Notice: Subject to any disclaimer, the term of this patent is extended or adjusted under 35 U.S.C. 154(b) by 0 days.

(21) Appl. No.: 13/055,736

(22) PCT Filed: Jul. 30, 2009

(86) PCT No.: PCT/CN2009/073002

§ 371 (c)(1), (2), (4) Date: Feb. 21, 2011

(87) PCT Pub. No.: WO2010/012234

PCT Pub. Date: Feb. 4, 2010

(65) Prior Publication Data

US 2011/0131726 A1 Jun. 9, 2011

(30) Foreign Application Priority Data

Jul. 31, 2008 (CN) ..... 2008 2 0113297 U

(51) Int. Cl.

| | |
|---|---|
| ***A47B 13/00*** | (2006.01) |
| *A47B 71/00* | (2006.01) |
| *A47B 7/00* | (2006.01) |
| *A47B 7/02* | (2006.01) |

(52) U.S. Cl. ..... 5/604; 5/600; 5/613; 5/617; 5/618

(58) Field of Classification Search ..... 5/600, 613, 5/617, 618, 604, 606

See application file for complete search history.

(56) References Cited

U.S. PATENT DOCUMENTS

| | | | | |
|---|---|---|---|---|
| 3,213,469 | A * | 10/1965 | Beeman | 5/618 |
| 5,377,370 | A | 1/1995 | Foster et al. | |

FOREIGN PATENT DOCUMENTS

| | | | |
|---|---|---|---|
| CN | 85201576 | U | 5/1986 |
| CN | 00222004.0 | | 11/2000 |
| CN | 1765348 | A | 5/2006 |
| CN | 200410046881.7 | | 5/2006 |
| DE | 3305692 | A1 | 8/1984 |

* cited by examiner

*Primary Examiner* — Jonathan Liu
(74) *Attorney, Agent, or Firm* — IPro, Inc.; Na Xu

(57) ABSTRACT

A multifunctional microcomputer controlled turn-over nursing bed comprises a bed board that may fold into a L-shape or a U-shape, middle longitudinal plates and left and right side plates wherein the left side plate or the right side plate each comprises a side pillow plate, an adjustable hand rest plate and a hip leaning plate, a movable frame, and a system of interchangeable toilet cover and toilet seat connected by the movable frame which allows excrement collection from a patient lying on the bed even when the bed is folded. The side pillow plate, the hand rest plate and the hip leaning plate may fold synchronously by a link shaft. The bed further comprises a head plate and a foot plate wherein each comprising a centre fixed plate and two active plates, which can be narrowed when two active plates are inserted into a centre fixed plate.

7 Claims, 4 Drawing Sheets

MULTIFUNCTIONAL TURN-OVER NURSING BED

TECHNICAL FIELD

The present invention relates to a bed, which belongs to the technical field of medical equipment.

BACKGROUND

Why is it difficult to find nursing beds with turn-over functions in hospitals and on the market? It is not because people do not need turn-over beds but because there is a certain degree of difficulty in the design. The programmable shape-change medical bed with complete functions (patent number: z100222004), for example, has new conception in the turn-over mode, but it is difficult to market because of its lack of comfort for hand positioning after turn-over, inadaptability to patients with different build, failure to achieve excrement collection during side turn-over and other key functions. Thus, although there are thousands of pathbreakers who design turn-over beds, most of the designs are still in an exploratory stage, or the bed has a turn-over function symbolically but has little clinical effect in reality. The nursing bed with a luxurious and perfect appearance has few functions with actual values, and most of the functions are in aspects of laying, leaning, bending legs, tilting or lifting the bed surface. Even in the case of the most advanced hospital bed at present in the United States, the kGL three-dynamic electric bed for the recovery of patients with fatal illness, made by the US Simmons company, has four disadvantages besides the exquisite technique and strong high-tech infiltration: 1. the bed cannot collect excrement, and cannot collect excrement when a patient lie on one side; 2. the bed cannot be moved for a long distance even if the bed can be moved out of the door, because the bed body is heavy and the bed cannot be narrowed; 3. a patient is easily clamped by guard rail boards, and when the patient leans to one side, and the patient skin is repeatedly rubbed with the bed body because of the body sliding (the counter measure is to use special material to make the sheets, which provides extra capillary fiber holes for jet massage to reduce the friction); 4. the bed is expensive so that it cannot be accepted by ordinary hospitals and cannot be marketed widely.

What deserves to be mentioned is that all nursing beds in the world at present use the barrier type guard rail boards with holes. The guard rail board is arranged at the edge of the bed, and it functions to prevent the patient from falling from bed, but does not help with the turn-over. Because the guard rail board has many gaps, its negative effects cannot be overlooked. It leaves the risk that the patient may be clamped. In the 21 years from 1985 to 2006, the United States has received 691 reports that patients are clamped by guard rail boards, and 413 patients are dead because of the clamping. Thus, the US FDA (US Food and Drug Administration) specially issues a hospital bed design guideline on the defect to reduce the injury of guard rail boards to patients.

Invention Contents

A multifunctional turn-over nursing bed comprises middle longitudinal plates which are composed of a back plate, a lower bed board and a toilet cover; the bed comprises a left side plate and a right side plate; each of the left and right side plates comprises a side pillow plate, a hand rest plate and a hip leaning plate; the side pillow plate, the hand rest plate and the hip leaning plate on a same side of the bed are discrete plates; the side pillow plate and the hip leaning plate on the same side of the bed are connected by a link shaft system; the hand rest plate is connected to both the side pillow plate and the hip leaning plate on the same side of the bed; the side pillow plate, the hand rest plate and the hip leaning plate on the same side of the bed are configured to fold synchronously. When only one side plate is folded while the middle longitudinal plate and the other side plate remain unfolded, the bed is configured into a L-shape; when both the left side plate and the right side plate are folded, the bed is configured into a U-shape. The L-shaped bed is convenient for side sleep when the side plate is turned up. A movable leg bending plate is folded on the lower bed board. The bed is further provided with a toilet seat and a movable frame located beneath the bed; the movable frame is connected to both the toilet cover and the toilet seat; the toilet cover and the toilet seat move simultaneously through the controlled move of the movable frame; such move is configured to allow the toilet cover and toilet seat to alternatively fill a toilet aperture in the bed. A head plate and a foot plate each comprises a center fixed plate and active plates on both sides of the cent fixed plate; when the active plates fold, the head plate or the foot plate or both is allowed to be narrowed. A monitor display is mounted in the middle of the foot plate. A bed foot rack is composed of a disc, a storage basket, four wheels and a pair of U-shaped foot rack pipes. A urinal extended from a toilet seat is connected with a head band. The urinal is a receptacle to receive the urine of a person with urinary incontinence or that of a bedridden person. Two horizontally extended parts of the lower end of the back plate near the hand rest plates are respectively provided with a link shaft. Pull rods are installed under both ends of the hand rest plate, and an elastic wrapper of the hand rest plate is arranged beneath the pull rods. An excrement storage box is hung under the shielding plate at the center bottom side of the bed.

By the available technologies, the present invention has improved, perfected and developed significantly on the basis of a Chinese application 200410046881.7.

Herein, turn-over refers to the turn-over of the whole bed body except the head plate and the foot plate and bed foot racks. The bed body comprises the middle longitudinal plates, the left and right side plates, the shielding plate, the excrement storage box, etc.

A link shaft with a circular sector cross section shape is inserted in the two horizontally extended parts of the lower end of the back plates near the hand rest plates. A link shaft is an improvement of a shaft connector. The shaft connector as a multiway shaft can be folded upwards, downwards, leftwards and rightwards, and its folding point is on the centerline. The link shafts only can be folded upwards in addition to performing conjoined rotation, and can be matched with the back plates and hand rest plates. The folded point is off-center and is moved above the bed board. The hinge ends of the link shafts and the hip leaning plates are provided with protruding tenons. When the push rod motor is started and the hip leaning plates are folded by the push rod of the side plate, it has the function for synchronously folding the side pillow plates. Then, the hand rest plates are folded together with it and slide outwards along the runner because of the extrusion force of the patient arms, and as such the side plates form U-shaped side plates to fit for the side sleep of all kinds of patients.

In the aforementioned excrement storage box, a heater of an automatic cleaning and drying system and a contact tip for a temperature controller are arranged in a water tank of the excrement storage box. The excrement storage opens up by rotating at 90° using the stud of the excrement storage box as the centre. The opened excrement storage box, the funnel and the bed pan are totally exposed to facilitate water injection and bed pan cleaning.

The bed in a narrowed form refers to the simultaneous narrowing of the bed board, the head plate and the foot plate. The bed board is narrowed by folding the left and right side plates of the bed, and as such the bed is configured into a U-shape. The head plate and the foot plate are narrowed because the push rod motor installed in the head plate and the foot plate simultaneously pulls the left and right active plates inwards.

The function of the aforementioned movable frame is to realize the alternative access of the toilet cover or the toilet seat. The bed is further provided with the toilet cover, the toilet seat, the movable frame and pendulum rods. The components form two active quadrangles if it is viewed from a plane, and the rollers of the toilet cover and the toilet seat are respectively inserted in a limit runner. When the movable frame is configured to moved in parallel to the longitudinal direction of the bed in a forwards and backwards fashion under the action of the push rod motor, the rollers slide horizontally and vertically in the limit runner to achieve the aim that the toilet cover and toilet seat alternatively fill a toilet aperture, so as to achieve the alternative access of the toilet cover or the toilet seat.

A hand rest plate wrapper is made of warp-weft bidimentional elastic fabric or rubber. It is mainly used for covering and decorating disconnected side plates. The upper part is installed under the edge of the bed; the lower part is installed on the extended parts of the lower end of the back plate near the hand rest plate; and the left part and right parts are respectively installed in the slots of the side pillow plate and hip leaning plate.

The urinal and the head band are shown in FIG. 4. In the FIG. 4, the unisex urinal is integrally connected with a safety belt. A forehead band and a jaw holding sleeve prevent a patient's head from sliding off the pillow when the patient is unconsciously leaning to one side. A hand rest bag plays the function of double insurance, and it circumvents the problem that a patient's hand is clamped when the change of the side plates and the hand rest plates occurs. The urinal is suitable for all men and women, belongs to disposable appliances, and is disposable after a single use.

A L-shaped bed board is formed by the combination of the middle longitudinal plates, one side plate laid flat and the other side plate turned up. The L-shaped bed board is used by patients who are slightly injured and feel inconvenient to turn over while they are conscious. For patients in a vegetative state, or for using the bed in a narrowed form for ease of transportation, a U shaped bed is formed. The shape is selected in accordance with the requirements of patients. The L-shaped bed board is formed under the control of a single chip microcomputer (SCM). When the left side plate is turned up, the right side plate is immobile; when the right side plate is turned up, the left side plate is immobile. Thus, back-and-forth movement is automatically achieved.

One end of each pull rod is installed on screw pins on both sides of the extended parts of the lower end of the back plate near the hand rest plate, and the other end is installed in the position limiting the lower part of the hand rest plate. When the side plate is laid flat, the pin shaft of the lower part of the hand rest plate is moved inwards in the runner of the pull rod, and the pull rod plays a protection function in the change of the hand rest plate.

The reason why the hand rest plate is automatically adjustable in accordance with patients with different build and automatically controls the arm embedding depth is shown in FIG. 7: when the side plate AO is upwards rotated by using O as the rotating centre, point B at the upper end of the hand rest plate BC slides from point A to point B through the runner; the point C at the lower end of the hand rest plate slides from point $O_1$ to point C through the runner of the pull rod. Therefore, the distance from the side plate to point C can be changed by rotating the side plate at different angles to achieve the purposes of fitting patients with different build and changing the arm embedding depth.

Compared with the prior art, the present invention has the following advantages: 1. the bed is designed with an ability to be configured into a L-shaped bed and is provided with adjustable hand rest plates, allowing increased comfort for patients; 2. the link shafts greatly simplified and rationalized the bed structure; 3. the alternative access to a toilet cover or a toilet seat is accurate and convenient; 4. the design of the pull rod and excrement storage box is simple and precise; 5. the urinal and head band ensure safety and the head band is convenient for patients to wear.

The bed enables all functions to be guaranteed, and adds the functions of monitoring, traction, etc. Because the bed is fully made of plastic and the microcomputer is introduced, the bed is more suitable for commercial manufacture, and has the advantages of simplified structure, increased degree of automation, beautiful appearance, and safer and more reliable performance.

FIGURE DESCRIPTION

Further explain the present invention by combining with the figures.

Figure 1:
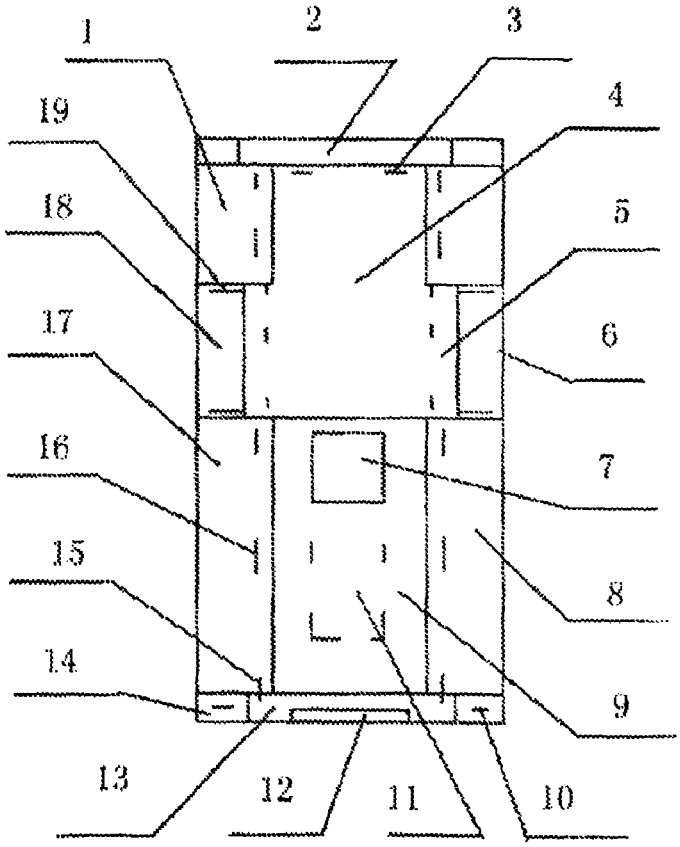
FIG. 1 is the structure diagram of the bed surface of the present invention.
Figure 2:
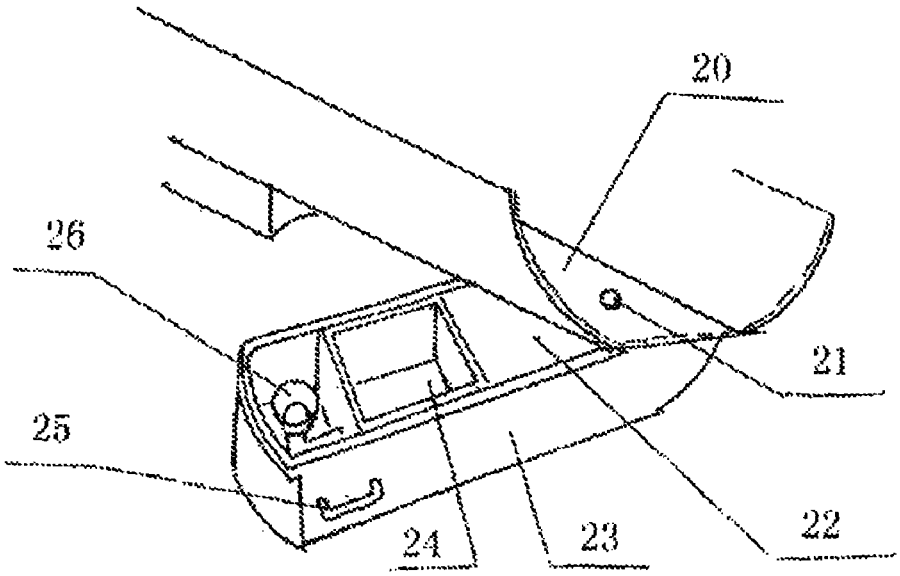
FIG. 2 is the structure diagram of the excrement storage box of the present invention.
Figure 3:
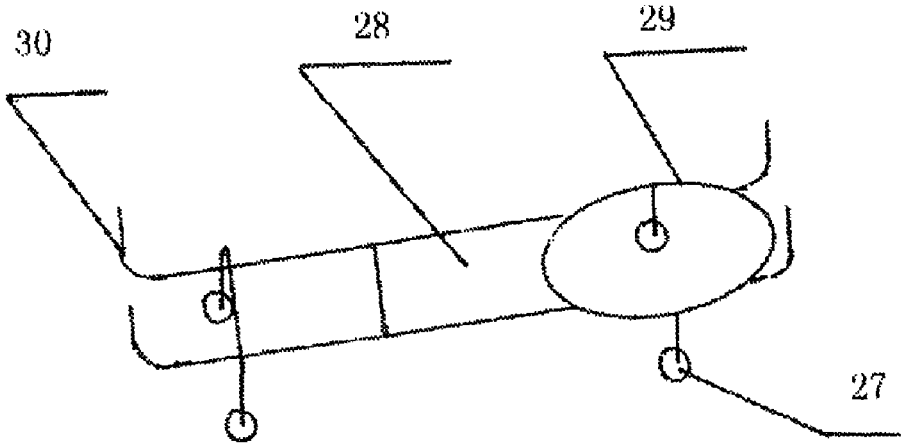
FIG. 3 is the structure diagram of the bed foot rack of the present invention.
Figure 4:
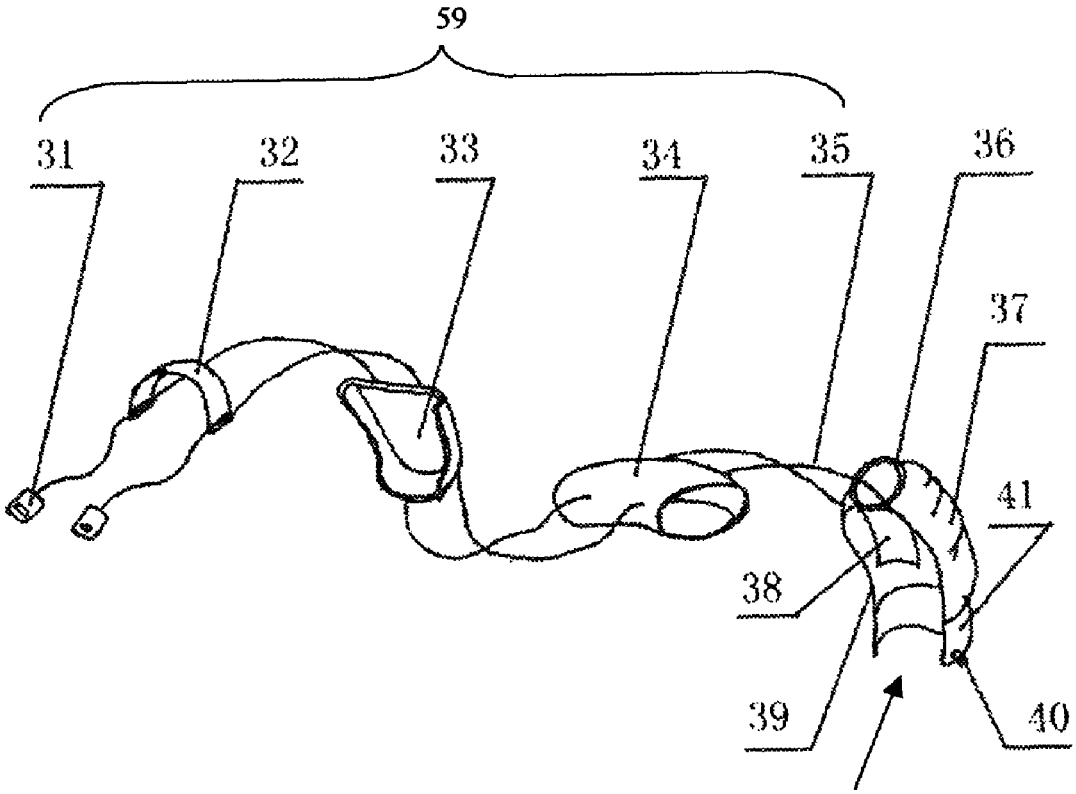
FIG. 4 is the structure diagram of the urinal and the head band of the present invention.
Figure 5:
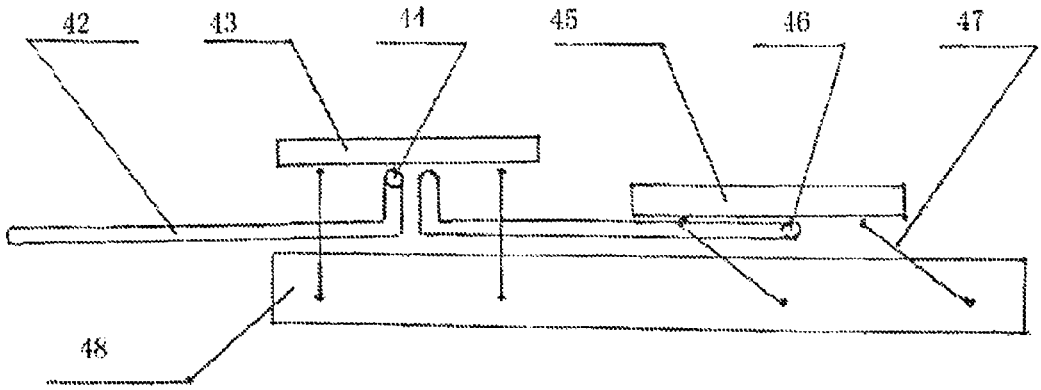
FIG. 5 is the structure diagram of mutual exchange between the toilet cover and toilet seat of the present invention.
Figure 6:
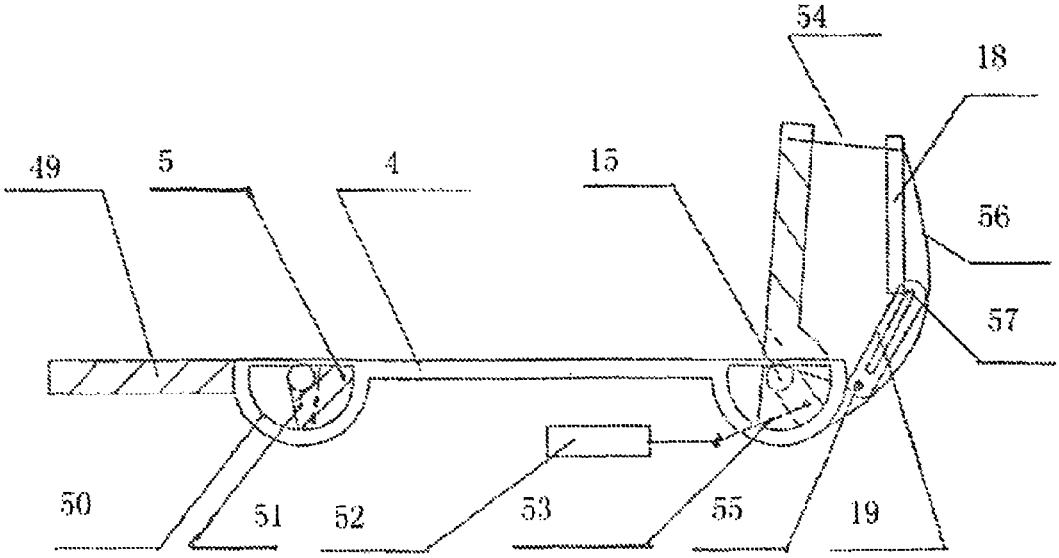
FIG. 6 is the structure diagram which shows the cross section of the present invention with one side plate turned up and the hand rest plate glided.

The figure numbers and corresponding component names are listed in the following table:

| Number | Name |
|---|---|
| 1 | Side Pillow Plate |
| 2 | Centre Fixed Plate |
| 3 | Buckle |
| 4 | Back Plate |
| 5 | Link Shaft |
| 6 | Edge of Bed |
| 7 | Toilet Aperture |
| 8 | Hip Leaning Plate |
| 9 | Lower Bed Board |
| 10 | Traction Mechanism |

-continued

| Number | Name |
|---|---|
| 11 | Leg Bending Plate |
| 12 | Monitor Display |
| 13 | Centre Fixed Plate |
| 14 | Active Plate |
| 15 | Plate End Shaft |
| 16 | Hinge Shafts In The Middle Section |
| 17 | Pressure Sensor |
| 18 | Hand rest Plate |
| 19 | Pull Rod |
| 20 | Shielding plate |
| 21 | Bolt |
| 22 | Water Tank |
| 23 | Excrement Storage Box |
| 24 | Bed Pan |
| 25 | Handle |
| 26 | Funnel |
| 27 | Wheel |
| 28 | Storage Basket |
| 29 | Disc |
| 30 | Foot Rack Pipe |
| 31 | Buckle Sheet |
| 32 | Forehead Band |
| 33 | Jaw Holding Sleeve |
| 34 | Hand rest Bag |
| 35 | Safety Belt |
| 36 | Opening |
| 37 | Rubber Sheath |
| 38 | Baffle Plate |
| 39 | Flexible Rib |
| 40 | Plug |
| 41 | U-Frame |
| 42 | Limit Runner |
| 43 | Toilet Cover |
| 44 | Toilet Cover Roller |
| 45 | Toilet Seat |
| 46 | Toilet Seat Roller |
| 47 | Pendulum Rod |
| 48 | Movable Frame |
| 49 | Side Plate |
| 50 | Exposed Body |
| 51 | Tenon |
| 52 | Push Rod Motor |
| 53 | Side Plate Push Rod |
| 54 | Runner |
| 55 | Screw Pin |
| 56 | Elastic Wrapper of Hand rest Plate |
| 57 | Pin Shaft |

Specific Embodiments

For embodiments of the present invention, refer to FIGS. 1 to 8.

The L-shaped bed board refers to the shape of the bed board which is formed by the middle longitudinal plates (4, 9) and one of the side plates (49) turned up. That is to say when only one side plate is folded while the middle longitudinal plate and the other side plate remain unfolded, the bed is configured into a L-shape. The left and right side plates of each comprises a side pillow plate (1), a hand rest plate (18) and a hip leaning plate (8); wherein the side pillow plate, the hand rest plate and the hip leaning plate on a same side of the bed are discrete plates; wherein the side pillow plate and the hip leaning plate on the same side of the bed are connected by a link shaft system; wherein the hand rest plate is connected to both the side pillow plate and the hip leaning plate on the same side of the bed; wherein the side pillow plate, the hand rest plate and the hip leaning plate on the same side of the bed are configured to fold synchronously. A pressure sensor (17) is located on the upper end of the hip leaning plate (8). The side plate is turned up by cooperation with a plate end shaft (15) at the foot plate, a plurality of hinge shafts (16) in the middle section of the lower bed board and a link shaft (5). The shafts are all aligned on the same line, and the turning angle is from 0° to 110° . When a patient turns over, the shape of the side plates can be automatically selected to be U-shape or L-shape according to the condition of the patient, and the L-shaped side plates are formed under the control of a single chip microcomputer (SCM) in order to achieve the automatic alternation of turning over to the left or to the right.

The whole bed is narrowed by simultaneously turning up the left and right side plates, and then inserting the left and right side plates and the active plates (14) on both sides of head plate into the centre fixed plate (2, 13) of the head plate. When both the left side plate and the right side plate are folded, the bed is configured into a U-shape. The inner part of the active plates is provided with a traction mechanism (10) which can be extended by a traction belt.

The excrement storage box (23) comprises a funnel (26), a bed pan (24) , a handle (25) and a water tank (22). The water pipe below the funnel (26) is connected with the water tank (22) by the bed pan (24). The excrement storage box (23) is hung under the platform of the shielding plate (20) by a bolt (21) of the water tank, and two handles (25) are arranged on both sides at the section of the funnel (26).

A pull rod (19) is formed from an iron plate. One end of a pull rod with a hole is installed on one side of the extended parts at the lower end of the back plate (4) near the hand rest plate section, and the other end of the pull rod with a runner is matched with a pin shaft (57) below the hand rest plate (18).

A link shafts (5) is located at and inserted into the two extended parts of the back plate (4) near the section of the hand rest plates (18). The upper end of the link shaft is connected with the side pillow plate (1), and the lower end of the link shaft is hinged with the hip leaning plate (8) in a folding mode.

The movable frame (48) is provided with eight pendulum rods which are split between two sides and installed on both sides of the toilet seat (45) and the toilet cover (43). The movable frame is configured to move in parallel to the longitudinal direction of the bed in a forward and backward fashion; such move is configured to allow the toilet cover and the toilet seat to alternatively fill a toilet aperture.

The wrapper (56) of the hand rest plate is made of warp-weft bidimentional elastic fabric or rubber, and is located below the hand rest plate (18) when the wrapper of the hand rest plate is positioned flatly. An upper part of the wrapper is fixed to the edge of the hand rest plate close to the bed edge (6); a lower part of the wrapper is fixed to the a lower end of an extended part of the back plate (4); and a left and a right parts of the wrapper are respectively inserted in a slots in the side pillow plate (1) and a slot in the hip leaning plate (8).

The urinal (60) is composed of a opening (36), two flexible ribs (39), a baffle plate (38), a U frame (41), left and right plugs (40) and a rubber sheath (37), with both sides of the opening (36) connected with the safety belts (35) of the head band (59).

The head band (59) is composed of buckle pieces (31), a forehead band (32), a jaw holding sleeve (33), a hand rest bag (34) and two serially connected safety belts (35). One end of each safety belt is inserted into the socket of buckle (3) on the head plate by the buckle piece, and the other end is connected with one side of the urinal opening (36).

Figure 7:
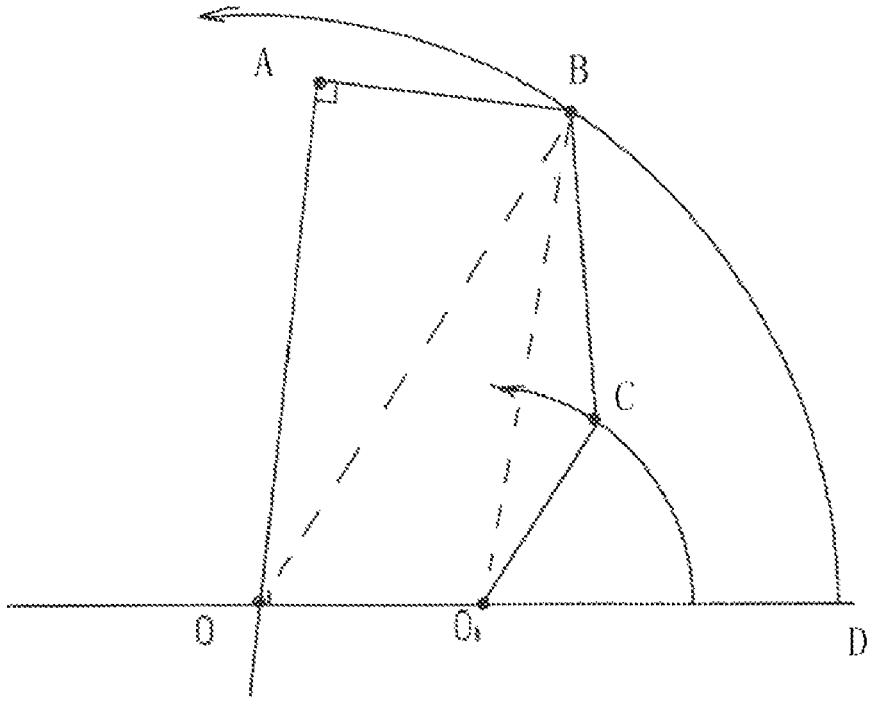
FIG. 7 is the schematic diagram of the automatic adjustment of the hand rest plates of the present invention.
Figure 8:
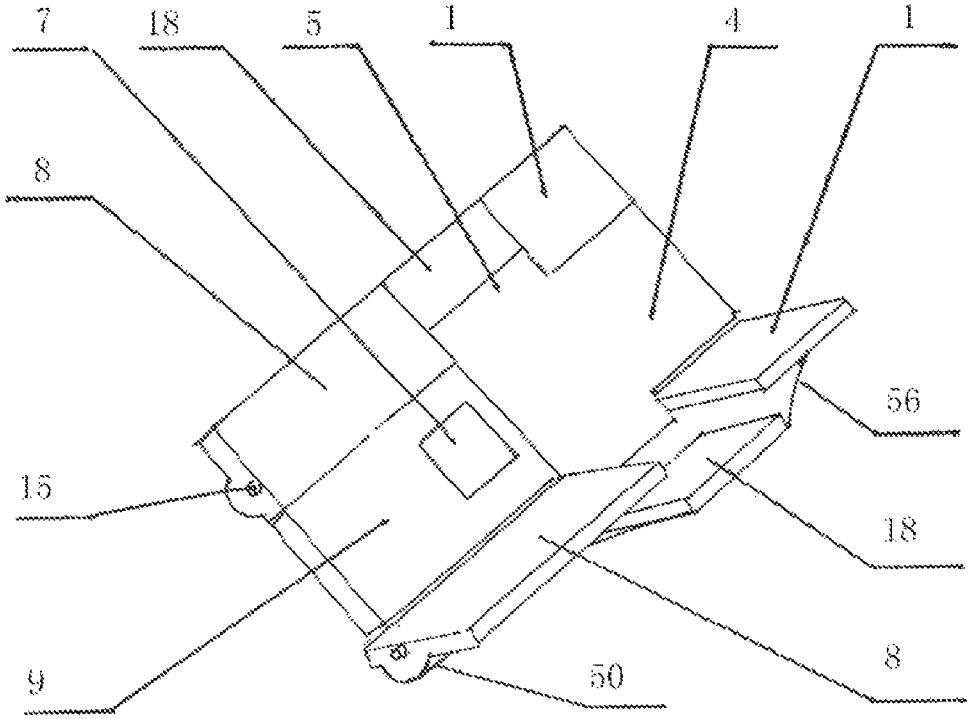
FIG. 8 is the diagram of folding of the L-shaped bed board and the shape of the concave hand rest plates of the present invention.

The hand rest plate (18) is adjustable automatically according to the different build of patients to automatically control the arm embedding depth, and the principle is shown in FIG. 7: In the polygon $ABCOO_1$, O represents the rotating center of the side plate, $O_1$ represents the rotating center of the pull rod, BC represents the hand rest plate, AB represents a sliding groove, AO represents the side plate, OB and $O_1C$ represent the two pendulum rods, and $O_1C$ also works as the pull rod. When the values of sides AO, $OO_1$, AB, BC and $CO_1$ are given and the sides respectively are rotated around O and $O_1$ in the same direction, $<CO_1D$ increases as long as $<AOD$ increases. When the values of sides OB and $OO_1$ are given, corresponding side $BO_1$ increases as long as $<BOO_1$ increases. Similarly, when side $BO_1$ increases, corresponding angle $<BCO_1$ increases; correspondingly, the vertical line from side $BO_1$ to point C is decreased, and the vertical line from side AO to point C is decreased at the same time; that is to say, the value of $<BOD$ is in inverse proportion to the length of the vertical line from side AO to point C. The lengths of the two pendulum rods OB and $O_1C$ are different, but the length of BC is fixed; so the different turning angles of the main pendulum rods results in the different distances from point C to side AO (in inverse proportion) As the build and the limbs of a person are in proportion, when a patient with thin and small build sleeps on the bed, the turning angle of the side plates will be larger, and the arm embedding depth is accordingly small, which is coincide with the scale of body configuration; and thus, the purpose of automatic adjustment is achieved.

Besides the turn-over manners of turning over the back plate and rolling the mattress, the known turn-over nursing beds have another turn-over manner, that is to laterally divide the bed into three sections. No concave hand rest place is provided, and the narrow side plates are not suitable for side sleep in bending over or bending leg posture; therefore, the hands will be pressed painfully in such posture. If the side plates are intended to form a concave space, the hand rest plates need to be divided into three sections and fully disconnected, which is difficult to design and use. The present invention makes essential breakthroughs in the aforementioned difficult problems, and presents solutions including: 1. the hand rest plates are configured to be reconnected automatically after being pressed down; 2. the depth of the hand rest plate is adjustable automatically according to the patients with different build, which is realized by changing the turning angle of the side plates and using the pull rod 0191; 3. the operation is simple and convenient.

All the known superior-quality nursing beds adopt barrier type guard rail boards with the disadvantages that patient fingers are easily clamped, and that the body of the patient tends to slide downward and has friction with the bed during the turn-over. The guard rail board of the our invention is formed by folding up or turning up the side pillow plates (1), the hand rest plates (18) and the hip leaning plates (8). This has the following advantages: 1. the guard rail board is optional, i.e. the guard rail board is not shown when the side plate is not folded up or turned up; 2. dimension after turning up the width of the bed is reduced to the utmost extent when both side boards are folded up or turned up; 3. the guard rail board is close to the patient, so the patient's body is ensured not to slide on the bed, and, 4. the problem of collecting excrement during turn-over is solved.

The multifunctional nursing bed described herein is convenient, portable, shapely, comfortable and safe, and is provided with the instruments for contraction, traction and monitoring.

We claim:

1. A nursing bed configured to support a patient, the nursing bed comprising:

a back plate configured to support the patient's back, the back plate comprising an upper portion and a lower portion, wherein the upper portion is positioned closer to the patient's head than the lower portion and the upper portion is narrower than the lower portion;

a lower bed board configured to support the patient;

the lower bed board comprising a toilet opening configured to allow the patient's excrement therethrough;

a left side pillow plate pivotally connected to a left side of the upper portion of the back plate, and a right side pillow plate pivotally connected to a right side of the upper portion of the back plate;

a left hand rest plate at a left side of the lower portion of the back plate, and a right hand rest plate at a right side of the lower portion of the back plate;

a left hip leaning plate pivotally connected to a left side of the lower bed board, and a right hip leaning plate pivotally connected to a right side of the lower bed board, wherein the left hip leaning plate is coaxial with the left side pillow plate and the right hip leaning plate is coaxial with the right side pillow plate;

a toilet cover configured to removably fit in an block the toilet opening, the toilet cover connected to a movable frame through pendulum rods;

a toilet seat configured to removably fit in the toilet opening and allow the patient's excrement therethrough, the toilet seat connected to the movable frame through said pendulum rods;

wherein the movable frame is configured to move parallel to and under the lower bed board and selectively position either the toilet cover or the toilet seat in the toilet opening.

2. The nursing bed of claim 1, wherein the left side pillow plate, the left hip leaning plate, and the left hand rest plate are configured to cooperatively and simultaneously fold toward the patient's body, and are configured to support the patient lying on the patient's side; and wherein the right side pillow plate, the right hip leaning plate, and the right hand rest plate are configured to cooperatively and simultaneously fold toward the patient's body, and are configured to support the patient lying on the patient's side.

3. The nursing bed of claim 1, further comprising a left pull rod having a slot and pivotally connected to the left side of the lower portion of the back plate, and a right pull rod having a slot and pivotally connected to the right side of the lower portion of the back plate.

4. The nursing bed of claim 1, further comprising a link shaft, wherein the link shaft is inserted into a left and a right extended parts of the back plate; wherein a cross sectional shape of the link shaft is a circular sector; wherein one end of the link shaft is connected with one of the side pillow plates; wherein another end of the link shaft is hinged with one of the hip leaning plates.

5. The nursing bed of claim 1, further comprising: a head plate and a foot plate each comprising a centre fixed plate and active plates on both sides of the centre fixed plate; wherein the head plate or the foot plate or both is narrowed when the active plates are inserted into the centre fixed plate.

6. The nursing bed of claim 1, further comprising: a pressure sensor located on an upper side of each of the hip leaning plates.

7. The nursing bed of claim 1, further comprising: a urinal removably attached to and extended from the toilet seat; wherein the urinal is composed of an opening, two flexible ribs, a baffle plate, a U frame, left and right plugs and a rubber sheath , and wherein both sides of the opening are connected with safety belts of the head band; wherein the safety belts have a forehead band, a jaw holding sleeve, and a hand rest bag.

* * * * *